US005446668A

United States Patent [19]

Herbert

[11] Patent Number: 5,446,668

[45] Date of Patent: Aug. 29, 1995

[54] FRANKING MACHINE

[75] Inventor: Raymond J. Herbert, Leigh-on-Sea, United Kingdom

[73] Assignee: Neopost Limited, Essex, United Kingdom

[21] Appl. No.: 992,702

[22] Filed: Dec. 18, 1992

[30] Foreign Application Priority Data

Dec. 19, 1991 [GB] United Kingdom ..... 9126998

[51] Int. Cl.[6] ..... G07B 17/00

[52] U.S. Cl. ..... 364/464.02

[58] Field of Search ..... 364/464.02, 464.03

[56] References Cited

U.S. PATENT DOCUMENTS

| | | | |
|---|---|---|---|
| 4,285,050 | 8/1981 | Muller | 364/464.02 |
| 4,306,299 | 12/1981 | Check, Jr. et al. | 364/464.03 |
| 4,327,410 | 4/1982 | Patel et al. | 395/425 |
| 4,445,198 | 4/1984 | Eckert | 364/464.02 |
| 4,706,215 | 11/1987 | Kirschner et al. | 364/466 X |
| 4,747,057 | 5/1988 | DiGiulio et al. | 364/466 X |
| 4,805,109 | 2/1989 | Kroll et al. | 364/464.02 |
| 4,807,141 | 2/1989 | Muller | 364/464.02 |
| 4,809,225 | 2/1989 | Dimmler et al. | 365/145 |
| 4,845,632 | 7/1989 | Kroll et al. | 364/464.02 |
| 4,860,254 | 8/1989 | Pott et al. | 365/145 |
| 4,916,623 | 4/1990 | Check, Jr. | 364/464.02 |
| 4,998,203 | 3/1991 | DiGiulio et al. | 364/464.02 |
| 5,260,900 | 11/1993 | Muller | 365/189.01 |

FOREIGN PATENT DOCUMENTS 0297777 1/1989 United Kingdom .

*Primary Examiner*—Edward R. Cosimano

*Attorney, Agent, or Firm*—Shoemaker and Mattare Ltd.

[57] ABSTRACT

A franking machine is disclosed in which the accounting memories are implemented by memory devices in which each storage location comprises a volatile and a non-volatile cell. During normal operation data is written to the volatile cells of the storage locations and in the event of a power down the data is transferred from the volatile to non-volatile cells. The volatile cells preferably are semi-conductor and the non-volatile cells are ferroelectric capacitative devices which retain their polarization without supply of power. The memory devices may provide storage for accounting data and other data processed by a micro-controller of the franking machine. In addition the memory device may be utilized to store other data which is not to be processed by the micro-controller. This other data includes program data and, in order to prevent this data being erased or over-written, gating circuits are provided to prevent write accesses by the micro-controller to areas of memory utilized for storing data which is not to be changed.

10 Claims, 3 Drawing Sheets

FRANKING MACHINE

BACKGROUND OF THE INVENTION

This invention relates to franking machines in which postage values used in franking mail items are metered and an account is maintained of the value of postage issued by the franking machine.

In known franking machines utilizing electronic circuits to carry out accounting and control functions in relation to use of the machine in franking mail items, non-volatile memory devices are provided to store accounting data. Such accounting data usually comprises a value of credit entered into the machine and available for use in issuing postage values for franking mail items, an accumulated value of postage used in operation of the machine, an items count comprising the number of items for which a postage value has been issued and a high items count comprising the number of items for which a postage value in excess of a predetermined value has been issued. The non-volatile memory may also store parameters used in operation of the machine and it has been proposed to store a history of faults occurring in the machine. As is well known in the franking machine art, it is essential that the accounting data is stored in a non-volatile manner because reliance is placed upon this accounting data by the postal authority for charging the user of the machine for postage value issued.

Memory devices commonly used in electronic franking machines are dynamic semi-conductor devices which retain data therein only so long as power is applied to the devices. When power to these devices is terminated any data residing in the storage location of the device is lost. Termination of power to a franking machine may occur due to a normal power down of the machine or due to an unpredicted interruption of a mains electricity supply to the machine. Accordingly in order to ensure that data is retained in the memory devices when power to the machine is terminated, a battery is provided for each memory device to maintain power at all times to the device and thereby prevent loss of data. Back up of the data is provided by storing replications of the data in two separate memory devices, each with its own dedicated battery back up power supply. Further in order to ensure that integrity of the accounting data can be maintained in the event of a fault condition relating to the memory devices or to the writing and reading of data into and from the memory devices, the data is replicated in each memory device. Thus usually, for each item of accounting data, each of the two memory devices has two registers so that four copies of each item of data are stored. The need to provide a battery to back up the power supply to each memory device is inconvenient and adds cost to the machine. To ensure that data is retained in the memory devices for a time sufficient to meet the specified requirements of postal authorities, worst case conditions must be used in calculating battery capacity needed to meet the specified requirements. The result is that the batteries and associated circuitry take up substantial areas of the printed circuit boards of the machine. It becomes necessary to compromise in the choice of memory device to be used and the worst case current drain of such devices becomes a critical factor in choice of device. A consequence is that memory devices with a smaller data storage capacity than desired have to be used in order to meet the conflicting requirement of battery capacity.

In an attempt to overcome the need for battery back up of power supply to the memory devices it has been proposed to use devices known as electrically erasable programmable read only memories, $E^2$PROMs. Such devices have been intended for use in a read only mode to store invariable data such as program routines utilized for operation of equipment. The data is written into the memory device initially and remains unchanged thereafter. While it is possible to write data into these semi-conductor devices, the devices are able to operate only for a limited number of erase/write cycles. Accordingly they can only be used in situations where re-writing of data is required infrequently and have not been suitable for use for the purpose of storing and retaining data which is frequently re-written during operation of equipment such as accounting data in franking machines.

While $E^2$PROM devices would be convenient to use for storage of account data in a franking meter due to their ability to store data for up to ten years without energization by any power, accounting in a franking meter is carried out for every franking cycle and involves writing of new accounting data to the memory device during each franking cycle. The operational life of a franking meter is generally specified as requiring the meter to be capable of carrying out $4\times10^6$ franking cycles, however $E^2$PROM devices which are generally available at the present time have an operational limit of $10\text{–}100\times10^3$ read/write cycles. Even one particular device of higher performance which is expensive has a limit of $2\times10^6$ write cycles. A further disadvantage of $E^2$PROM memory devices currently available is that the writing cycle for writing data in the memory is long compared with dynamic memory devices and this limits the use of such devices to situations where only small amounts of data are required to written in each write cycle. In some franking machines, the length of write time of the $E^2$PROM devices may preclude use of such devices.

SUMMARIES OF THE INVENTION

According to one aspect of the invention a franking machine includes electronic accounting and control circuits; storage means for storing data; said storage means being switchable between volatile and non-volatile modes of operation; said storage means being effective when in said non-volatile mode to retain stored data when a potential of predetermined magnitude is supplied to the storage means and when the potential is less than said magnitude and being effective in the volatile mode to retain stored data only when said potential of predetermined magnitude is supplied to the storage means; said accounting and control circuits being operative during normal operation of the franking machine to maintain said storage means in said volatile mode and to read and write data from and to said storage means and being operative in response to a power down condition in which said potential decreases to less than said predetermined magnitude to switch said memory means from said volatile mode of operation to said non-volatile mode of operation.

According to another aspect of the invention data storage means includes a plurality of storage locations, each storage location including first means to store data in a volatile mode and second means to store data in a non-volatile mode; read write signal input means to determine a read or a write operation; a plurality of address signal input means to determine access to a selected storage location; and control means responsive to a read/write signal on said read write input means to permit access to any of said storage locations when the read/write signal determines a read operation is to be effected and to inhibit at least one address signal input means to inhibit access to a predetermined storage n when a write operation is determined by said read/-write signal.

BRIEF DESCRIPTION OF THE DRAWING

An embodiment in accordance with the invention will now be described by way of example with reference to the drawings in which.

DESCRIPTION OF THE PREFERRED EMBODIMENT

Figure 1:
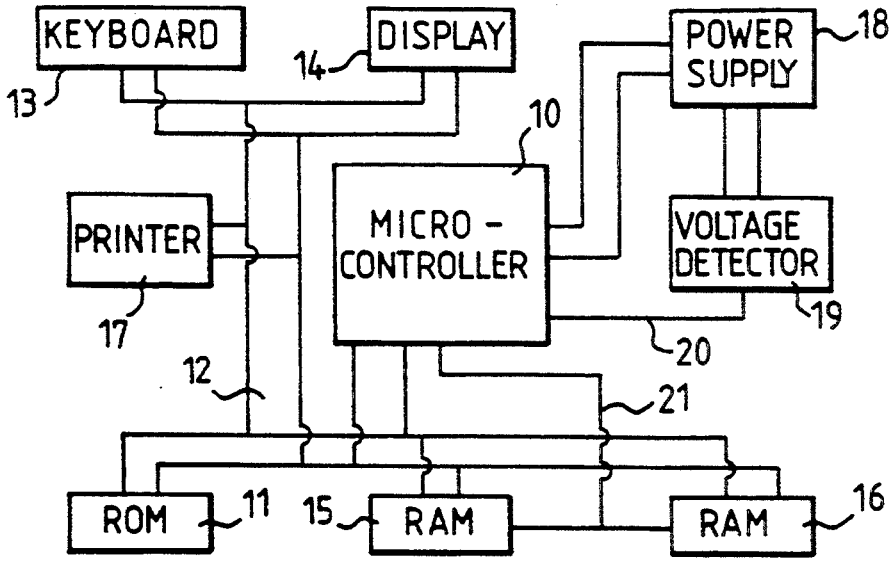
FIG. 1 is a block diagram of an electronic franking machine.

Referring first to FIG. 1, a franking machine comprises an electronic micro-controller 10 for carrying out accounting and control functions during operation of the franking machine under the control of program routines stored in a read only memory 11 (ROM). The ROM 11 is connected to the micro-controller by means of a bus 12. A keyboard 13 is connected to the micro-controller by the bus 12 to enable input of data and control signals to the micro-controller by a user of the machine. A display device 14, connected to the micro-controller by the bus 12, is driven by the micro-controller to echo inputs on the keyboard and to display information to the user of the machine relating to operation and status of the machine. Accounting data is stored in memory devices 15, 16 (RAM) connected to the bus 12. Each memory device 15, 16 includes two sets of registers. Each set of registers includes a descending register for storing a value of credit entered into the machine and available for use in franking mail items with postage charges. Each time an item is franked, the value of credit is decremented by the value of postage charge used in franking the item so that at any time the value in the descending credit register is the value of credit currently available for future franking of items by the machine. Each set of registers also includes an ascending tote register which stores an accumulated value of postage used by the machine in franking mail items. In addition each set of registers includes an items count register to store the number of mail items franked and a high items count register to store the number of mail items franked with a postage charge in excess of a predetermined value. Thus four replications of each accounting data item are stored in the memory devices 15, 16. Storing of the data in two separate memory devices enables recovery of data in the event of loss of data in one of the memory devices due to a catastrophic failure of that memory device. Storing of four replications of each accounting data item enables verification of the integrity of the data stored in the registers and recovery of data in the event of a fault occurring in writing of the data to one of the sets of registers. As is well known in the franking machine art, in each operating cycle in which the franking machine carries out a franking program routine to frank a mail item with a value of postage charge selected by entry on the keyboard 13, the micro-controller 10 carries out a sub-routine to check the integrity of the accounting data stored in the registers of the memory devices 15, 16 and checks to determine if there is a sufficient value of credit remaining in the descending credit register to permit the required franking to be effected. Printing of the franking impression on the mail item is effected by a printing device 17 connected to the bus 12 and controlled by the micro-controller 10.

The franking machine is powered by a power supply 18 which derives power from a mains electricity supply, usually a high voltage AC supply, and converts the power to a low voltage DC supply to power the electronic circuit blocks shown in FIG. 1. The low voltage DC supply may be distributed to the circuit blocks by means of power lines in the bus 12. When the franking machine is powered up, it is necessary to ensure that mal-functions of the electronic circuits do not occur in the period during increase of the DC supply from zero up to normal operating potential for the circuits. Accordingly a voltage sensor 19 is provided to detect the magnitude of the DC output from the power supply and to inhibit operation of the micro-controller by means of a signal on line 20 when the DC supply voltage is below a normal operating potential. Thus the micro-controller is maintained inhibited until the DC supply from the power supply 18 has built up to the required operating potential for the circuits. When a power down of the franking machine occurs, due either to switching off of the mains input or to an unpredicted failure of the mains supply, the micro-controller effects a power down routine in which flags are set to indicate the current status of the micro-controller and associated circuits. Setting of these flags enables the micro-controller to detect the status existing at power down and, if required, to complete any program routine which was incomplete at power down. The flags may be storage locations in one or both of the memory devices 15, 16. The power supply is constructed so that upon occurrence of a termination or decrease in magnitude of the power input to the power supply the DC voltage output from the supply holds up for a sufficient period of time to enable the micro-controller to carry out and complete the power down routine.

It will be appreciated that it is essential that the accounting data stored in the memory devices is retained during any time period during which the franking machine is not powered. Similarly the setting of the flags must be retained in order to permit the micro-controller to resume and complete any program routine being carried out at the time of power down.

The memory devices 15, 16 comprise semi-conductor storage locations which include ferroelectric non-volatile storage cells 52, 53. The memory devices are random access memories which operate selectively in volatile and non-volatile modes. In volatile mode, while operating potential is supplied to the memory, data may be written to the memory and is retained by the semi-conductor storage locations so long as the potential of required magnitude for operation is supplied. The data is lost when the applied potential falls to zero or falls to a magnitude insufficient to operate the memory devices. In non-volatile mode data written to the memory is retained by the ferroelectric non-volatile storage cells even when operating potential to the memory is terminated or decreased below a required magnitude for operation. Each storage location of the memory device is provided with a thin film ferroelectric storage cell and in the non-volatile mode the ferroelectric storage cells are polarized in dependence upon the value of the data item and retain the data item in the absence of power. However the read and write cycle times are longer in the non-volatile mode than in the volatile mode. Furthermore the ferroelectric storage cells are capable of only a limited number of write cycles. In the volatile mode the polarization of the ferroelectric storage cells is not switched and hence the memories are not subject to any limitation in number of write cycles when operating in the volatile mode. Memory devices constructed and operable as hereinbefore described have been developed by Ramtron International Corporation and are described in European Patent specification No. 0 297 777.

During operation of the franking machine the memory devices 15, 16 are provided with power from the power supply 18 and are operated in volatile mode. Accounting data is read from the memories and new accounting data is written to the memories in each franking cycle. When power to the franking machine is terminated due to a normal power down or is terminated or reduced below a required operating level due to an unpredicted fault, the micro-controller carries out a power down routine which includes switching the memory devices from volatile to non-volatile mode of operation. Reduction or termination of power input is sensed by the voltage sensor 19 and a low voltage signal is input to the micro-controller on line 20. In response to the low voltage signal on line 20, the micro-controller 10 outputs a power down signal on a line 21 connected to both memory devices 15, 16 to switch the memories from volatile to non-volatile operation. The memory devices include memory control circuits to apply signals as described in European patent specification No. 0 297 777 to cause each of the ferroelectric storage cells to be polarized to correspond to the state of the volatile semiconductor location with which the cell is associated. Thus data stored in the volatile semiconductor locations is transferred to the associated ferroelectric cell. Upon power up, or restoration of power, the micro-controller 10 outputs a power up signal on line 21 to apply signals such as to cause the semi conductor storage locations to be set to states corresponding to the polarities of the ferroelectric cells associated therewith.

Figure 2:
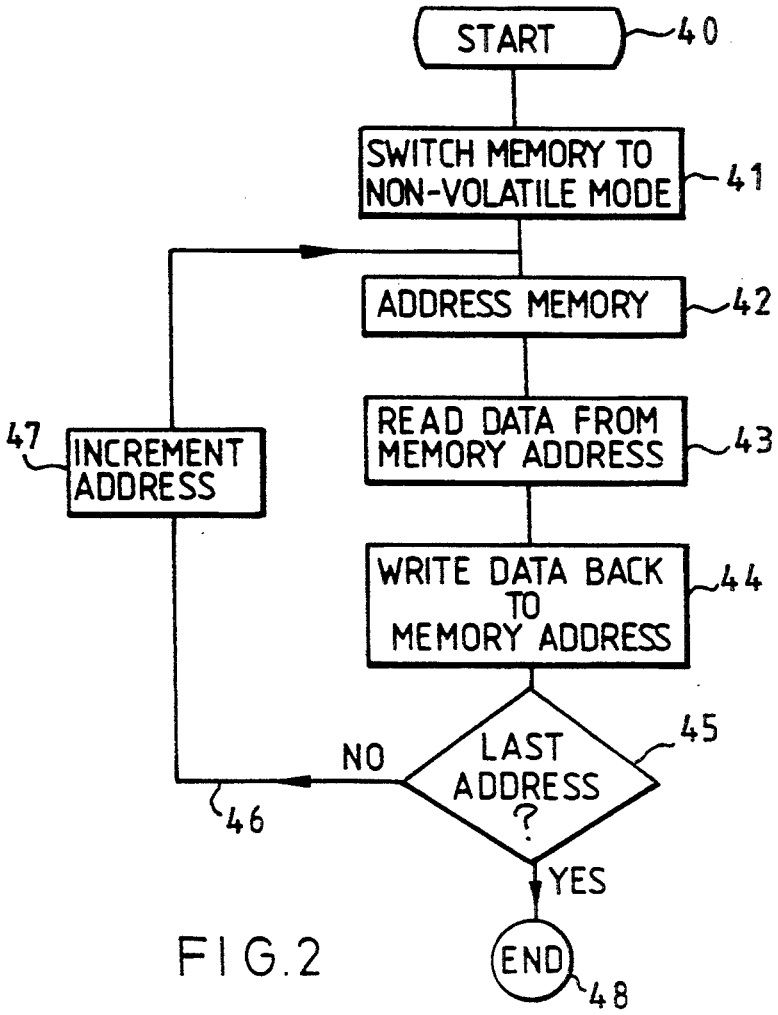
FIG. 2 is a flow chart of a power down sub-routine.

An alternative power down subroutine is shown in the flow chart of FIG. 2. The micro-controller in response to the low voltage signal on line 20 outputs a power down signal on line 21 to the memory devices to switch the memory devices from volatile to non-volatile operation. The micro-controller then carries out a refresh operation on all storage locations of the memories 15, 16 in which the content of each storage location is read out and then rewritten back into the same storage location. Thus data stored while the memory operated in volatile mode is read out and is written back into the memory while it is in non-volatile mode. Writing the data into the memory while in non-volatile mode causes the ferroelectric storage cells to be polarized to represent the data items and thereby the memories retain the data until next time power is supplied to the franking machine.

Referring to FIG. 2, after the START 40 of the refresh operation, the first step 41 of the operation is "SWITCH MEMORY TO NON-VOLATILE MODE" after which step 42 "ADDRESS MEMORY" is carried out. The next step 43, "READ DATA FROM MEMORY ADDRESS" is followed by step 44, "WRITE DATA BACK TO MEMORY ADDRESS". If a decision 45 "LAST ADDRESS?" results in "NO", the operation proceeds along flow line 46 to the step 47 "INCREMENT ADDRESS" and then returns to step 42 "ADDRESS MEMORY". If the decision 45 "LAST ADDRESS?" results in "YES" the refresh operation "ENDS", step 48.

Because batteries are not required to provide back-up power to the memory devices the need for compromise between battery capacity and memory capacity is eliminated and memory devices of desired capacity may be provided. A random access memory is required for use as a working store for temporary storage of data during operation of the micro-controller in a program routine. Due to the constraint placed upon the capacity of battery backed memory devices, the working store is usually implemented by an additional memory device. This has the disadvantage of requiring space on the printed circuit board together with additional costs. By using memory devices which do not require battery power back-up, the capacity of the memory devices may be chosen to be sufficient to meet the need not only for storing data, such as accounting data, which must be retained but also to provide additional storage capacity. The ferroelectric memory devices are not subject to any limitation on the number of write cycles while in the volatile mode and hence the additional storage capacity may be used as a working store for the micro-controller. It will be appreciated that the data stored in the working store is not permanent data and is not required to be retained upon occurrence of a power down. Therefore in a power down routine it is not necessary to read and write back the data in those storage locations used as a working store.

Figure 3:
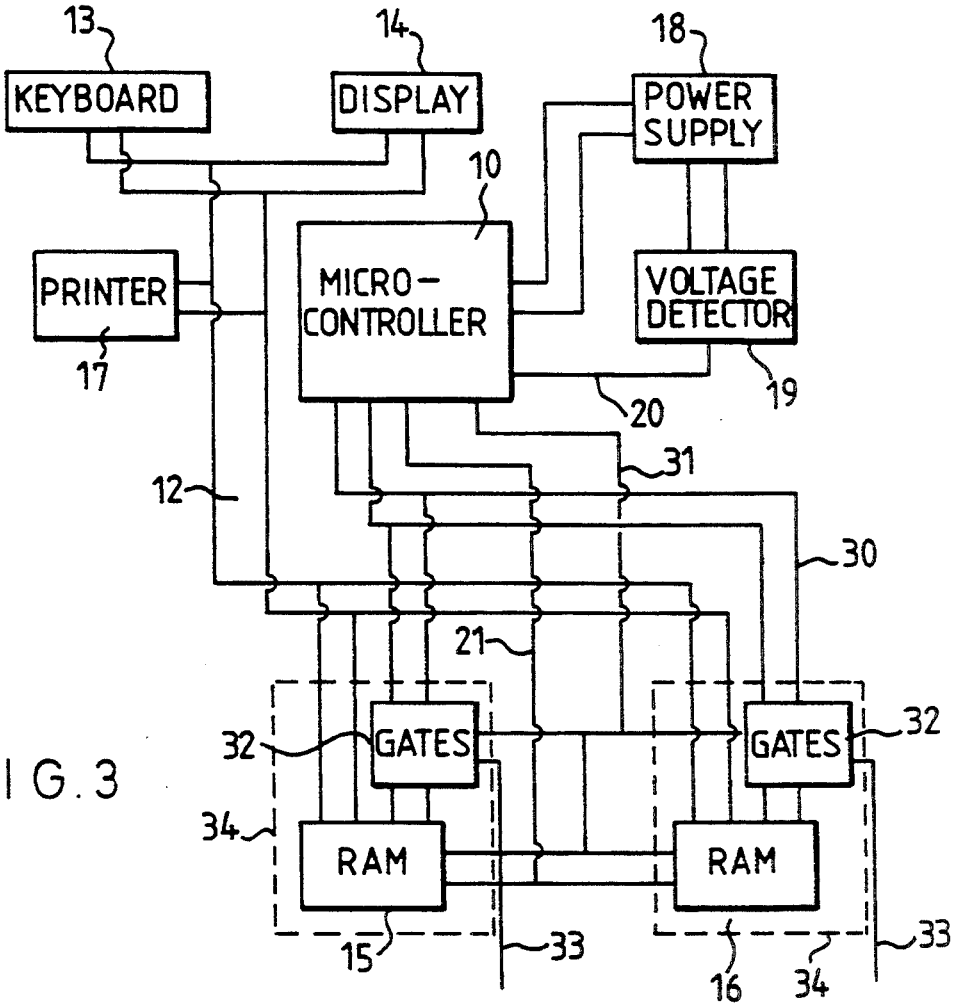
FIG. 3 is a block diagram of a modification of the franking machine shown in FIG. 1.

The memory devices described hereinbefore having volatile and non-volatile modes of operation are useful for storing accounting data in the volatile mode during powering of the franking machine and for storing that data in the non-volatile mode during times when power is not supplied to the franking machine. During use of the franking machine, the accounting data undergoes processing as franking operations and recrediting of the franking machine are performed and the stored data is rewritten with updated data. Similarly the data in temporary working storage locations is rewritten as the temporarily stored data is updated. There is also a requirement to store program data for programmed operation of the micro-controller. Usually program data is stored in read only memory and hence as described hereinbefore in relation to FIG. 1, a separate read only memory (ROM) device 11 to store the program data has been provided. However in order to economize on space occupied by the memory devices and on cost it would be convenient to use the same memory devices for the purposes of storing not only accounting and temporary data but also for storing program data. Accordingly in a modified circuit as shown in FIG. 3, the separate ROM has been dispensed with and program data is stored in storage locations of one or both of the memory devices utilized for storing accounting data. While, during operation of the franking machine, the accounting data and temporarily stored data is subject to rewriting periodically as operations are performed, rewriting of the program data would result in malfunctioning of the franking machine. Accordingly means are provided to prevent rewriting or erasure of program data as will be described hereinafter.

Figure 4:
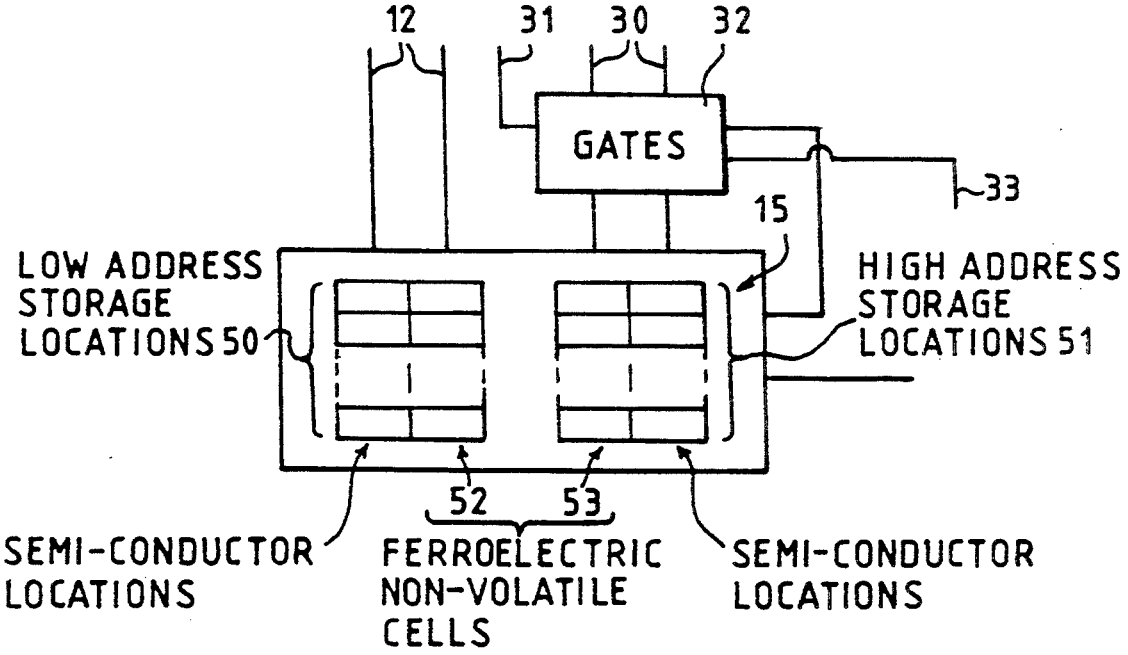
FIG. 4 is a block diagram of a memory device of the franking machine.

Referring to FIGS. 3 and 4, the circuit of FIG. 3 is generally similar to that of FIG. 1 and elements present in both Figures have the same references. The bus 12 by which the micro-controller communicates with the keyboard, display, printer and memory devices 15, 16 includes a data bus and an address bus for low order addresses. Data which is subject to rewriting during normal operation of the franking machine is stored in low address storage locations 50 of memory devices 15, 16. Program data and any other data which it is desired should not rewritten or erased is stored in high order address storage locations 51 of the memory devices 15, 15. A high order address bus 30 carries high order address signals from the micro-controller to the memory devices 15, 16. When a read operation is to be effected, the micro-controller holds a read/write line 31 at a first level and addresses via the low order address bus of bus 12 or the high order address bus 30 the required storage location 50, 51 of the devices 15 or 16 and data is read from the addressed locations on the data bus of bus 12. When a write operation is to be effected, the required storage location is addressed in the same manner but the read/write line 31 is held at a second level. In order to provide protection against unintended rewriting or erasure of data stored in the high order address storage locations, gating circuits 32 are provided in the high order address bus 30. The gating circuits are controlled by an input from the read/write line 31 so that when the read/write line 31 is at the second level required for writing to the memory devices the gating circuits 32 inhibit passage of the high order address signals from the micro-controller to the memory devices 15, 16. Accordingly the micro-controller is prevented from accessing high order storage locations when the read/-write line is at the second level required for writing. When the read/write line is at the first level for reading, the gating circuits permit the high order address signals to pass to the memory devices and thereby enable accessing of the high order address locations for reading data therefrom. Thus the micro-controller is able to both read and write from and to storage locations having a low order address and is able to read from storage locations having a high order address. But the micro-controller is prevented from accessing storage locations having a high order address when a write operation is attempted. The high order address bus may comprise a single address line or a plurality of address lines as may be required.

It will be appreciated that occasionally it may be required to write new or modified program or other data into the high order address locations. In order to permit such writing an over-ride control input 33 is provided which enables the gating circuits to pass the high order address signals when the read/write line 31 is at the second level for writing. The input 33 is external to the micro-controller and hence cannot be activated by the micro-controller. The input 33 may be activated by a service engineer and activation thereof may be by means of a manual switch or key within the secure housing of the franking machine and which is accessible only by authorized personnel. The gating circuits 32 may be a part of and integrated with the memory devices 15, 16 as indicated by broken lines 34. It is to be understood that the provision of gating circuits protecting accesses to high order addresses is an example of protecting an area in the memory devices 15, 16 and that if desired other predetermined areas may be protected in a similar manner by the provision of gating circuits responsive to a write signal to prevent addressing of predetermined addresses during a writing operation. The protection of predetermined addresses may be provided for both or one of the memory devices 15, 16.

During powering up of the franking machine, as described hereinbefore, the micro-controller is inhibited from operation until the DC output voltage from the power supply has risen to a desired operating potential. At the time of initiation of operation of the micro-controller, the energization of line 21 is such that the memory devices 15, 16 are in volatile mode of operation.

I claim:

1. A franking machine including electronic accounting and control circuits; data storage means including a plurality of first storage locations for storing first data and a plurality of second storage locations for storing second data; each said first storage location and each said second storage location being switchable between a volatile mode of operation and a non-volatile mode of operation; said storage locations being effective in said volatile mode of operation to retain data stored therein only when an energizing potential of at least a predetermined magnitude is supplied to the storage means and being effective in said non-volatile mode of operation to retain said data stored therein when said energizing potential is less than said predetermined magnitude; power means operative during normal operation of the franking machine to apply said energizing potential of at least said predetermined magnitude to said storage locations of said data storage means; said storage locations during normal operation of the franking machine being in said volatile mode of operation and said accounting and control circuits being operative to generate address signals to address selected ones of said storage locations and to generate a control signal having a first state for writing and a second state for reading respectively to and from said selected ones of said storage locations; control means operative in response to said control signal being in said first state during normal operation of the franking machine to inhibit addressing of each of said plurality of second storage locations; and said accounting and control circuits being operative in response to a power down condition in which said energizing potential decreases to less than said predetermined magnitude to switch said storage locations of said storage means from said volatile mode of operation to said non-volatile mode of operation.

2. A franking machine as claimed in claim 1 wherein the accounting and control circuits are operative after switching the storage locations to the non-volatile mode of operation in response to the power down condition to address said first storage locations to read data stored therein and to write said data back into said first storage locations.

3. A franking machine as claimed in claim 1 wherein the first and second storage locations each comprise a volatile semi-conductor storage location and include a non-volatile ferroelectric storage cell associated one with each semi-conductor storage location respectively.

4. A franking machine as claimed in claim 1 including means operable to input a write permit signal to the control means to inhibit operation of said control means and thereby permit addressing of the second storage locations when the control signal has the first state.

5. A franking machine as claimed in claim 1 wherein the storage means includes first address inputs and a second address input for input of the address signals to said storage means; the first storage locations being selected by address signals on said first address inputs and the second storage locations being selected by address signals on said first address input and on said second address input; and wherein the control means includes getting means connected to said second address input operative in response to the control signal having the first state to inhibit input of address signals to said second address inputs.

6. A franking machine as claimed in claim 5 wherein the first address inputs are low order address lines and the second address input is a high order address line, the first storage locations having low order addresses and being accessed by low order address signals on said low order address lines and the second storage locations having high order addresses and being accessed by a combination of low and high order address signals on said low and high order address lines.

7. A franking machine as claimed in claim 1 wherein said plurality of first storage locations and said plurality of second storage locations are implemented in a single memory device.

8. A franking machine as claimed in claim 7 wherein said first storage locations of said storage means store first data comprising accounting data modifiable by said accounting and control circuits during operation of the franking machine and said second storage locations store second data comprising data which is not to be modified during operation of the franking machine.

9. A franking machine as claimed in claim 7 wherein said first storage locations include a first group of storage locations to store accounting data modifiable by said accounting and control circuits during operation of the franking machine and a second group of storage locations utilized by said accounting and control means as working store for temporary data generated by said accounting and control circuits and wherein said second storage locations store second data which is not to be modified during operation of the franking machine.

10. Data storage means including a plurality of first storage locations for storing first data and a plurality of second storage locations for storing second data; each said first storage location and each said second storage location being switchable between a volatile mode of operation and a non-volatile mode of operation; said storage locations being effective in said volatile mode of operation to retain data stored therein only when an energizing potential of at least a predetermined magnitude is supplied to the storage means and being effective in said non-volatile mode of operation to retain said data stored therein when said energizing potential is less than said predetermined magnitude; power means operative to apply said energizing potential of at least said predetermined magnitude to said storage locations of said data storage means; said storage locations being in said volatile mode of operation when said energizing potential of at least said predetermined magnitude is present; a first control circuit operative when said energizing potential of at least said predetermined magnitude is present to generate address signals to address selected ones of said storage locations and to generate a control signal having a first state for writing and a second state for reading respectively to and from said selected ones of said storage locations; second control means operative in response to said control signal having said first state to inhibit addressing of each of said plurality of second storage locations; and said first control circuit being operative in response to a power down condition in which said energizing potential decreases to less than said predetermined magnitude to switch said storage locations of said storage means from said volatile mode of operation to said non-volatile mode of operation.

* * * * *